US006127988A

United States Patent [19]

McNichol

[11] Patent Number: 6,127,988

[45] Date of Patent: Oct. 3, 2000

[54] FIXED WIRELESS BASE STATION ANTENNA ARRANGEMENT

[75] Inventor: John Duncan McNichol, Devon, United Kingdom

[73] Assignee: Nortel Networks Limited, Montreal, Canada

[21] Appl. No.: 09/073,389

[22] Filed: May 5, 1998

[51] Int. Cl.[7] ..... H01Q 1/12; H01Q 21/00

[52] U.S. Cl. ..... 343/844; 343/879; 343/890

[58] Field of Search ..... 343/844, 878, 343/879, 890, 893; H01Q 1/12, 21/00

[56] References Cited

U.S. PATENT DOCUMENTS

| | | | |
|---|---|---|---|
| 4,446,465 | 5/1984 | Donovan | 343/797 |
| 5,365,571 | 11/1994 | Rha et al. | 379/59 |
| 5,872,548 | 2/1999 | Lopez | 343/890 |

FOREIGN PATENT DOCUMENTS

| | | | |
|---|---|---|---|
| 0106 494 A2 | 4/1984 | European Pat. Off. . | |
| 0106494 | 4/1984 | European Pat. Off. . | |
| 0435283 | 12/1990 | European Pat. Off. | H04B 7/26 |
| 0802579 | 10/1997 | European Pat. Off. | H01Q 21/28 |
| 0802579 A2 | 10/1997 | European Pat. Off. . | |
| 2281176 | 8/1993 | United Kingdom | H04Q 7/30 |
| 2292865 | 8/1994 | United Kingdom | H04Q 7/36 |
| 2281 176 | 2/1995 | United Kingdom . | |
| 2320618A | 6/1998 | United Kingdom . | |
| WO94/29972 | 6/1993 | WIPO | H04B 7/26 |
| WO96/13952 | 10/1994 | WIPO | H04Q 7/36 |

*Primary Examiner*—Don Wong
*Assistant Examiner*—Hoang Nguyen
*Attorney, Agent, or Firm*—Lee, Mann, Smith, McWilliams, Sweeney & Ohlson

[57] ABSTRACT

An antenna arrangement for a fixed wireless access base station comprising at least one pair of directional antenna wherein the pair of antennas have a common phase centre. If both antenna in the pair then operate on the same frequency channels, the correlation of fading of same sector co-channel interference can be maximised. To provide full cell coverage a plurality of pairs of antenna are arranged spaced apart in a tier about a support and to provide spatial diversity a second tier of antenna substantially the same as the first and which is vertically separated from the first tier is added.

20 Claims, 7 Drawing Sheets

DOWNLINK SCENARIO

FIXED WIRELESS BASE STATION ANTENNA ARRANGEMENT

This application claims priority from Great Britain Application No.: 9727346.0 filed Dec. 24, 1997 in the name of Northern Telecom Limited.

FIELD OF THE INVENTION

This invention relates to a radio communications system and in particular relates to a base station arrangement in a fixed wireless access system.

FIELD OF THE INVENTION

Fixed wireless access systems are currently employed for local telecommunication networks, such as the IONICA system. Known systems comprise an antenna and decoding means which are located at a subscriber's premises, for instance adjacent a telephone. The antenna receives the signal and provides a further signal by wire to a decoding means. Thus subscribers are connected to a telecommunications network by radio link in place of the more traditional method of copper cable. Such fixed wireless access systems will be capable of delivering a wide range of access services from POTS (public operator telephone service), ISDN (integrated services digital network) to broadband data. The radio transceivers at the subscribers premises communicate with a base station, which provides cellular coverage over, for example, a 5 km radius in urban environments. A typical base station will support 500–2000 subscribers. Each base station is connected to a standard PSTN switch via a conventional transmission link/network.

When a fixed wireless access telecommunications system is initially deployed, then a base station of a particular capacity will be installed to cover a particular populated area. The capabilities of the base station are designed to be commensurate with the anticipated coverage and capacity requirement. Subscribers' antennas will be mounted outside, for instance, on a chimney, and upon installation will normally be directed towards the nearest (or best signal strength) base station or repeater antenna (any future reference to a base station shall be taken to include a repeater). In order to meet the capacity demand, within an available frequency band allocation, fixed wireless access systems divide a geographic area to be covered into cells. Within each cell is a base station through which the subscribers' stations communicate; the distance between the cells being determined such that co-channel interference is maintained at a tolerable level. When the antenna on the subscriber premises is installed, an optimal direction for the antenna is identified using monitoring equipment. The antenna is then mounted so that it is positioned towards the optimal direction.

There are a number of alternative ways of providing access to the public telephone network, besides fixed wireless access systems. One method is to use copper or optical fibre cable. However, this involves digging up streets in order to lay cables past all the homes in the service area which is expensive, time consuming and causes noise, dirt, damage to trees and pavements and disrupts traffic. After the initial high investment the telephone company can then only start to recoup its investment as new subscribers join the system over a period of time. Another alternative is cellular radio such as GSM. This has the advantage that the telephones are mobile. However, the system operator has to provide continuous coverage along motorways, in shopping malls, and so on. The low-height omni directional antenna used in mobile systems gives little discrimination against multipath interference, and its low height makes it more susceptible to noise.

Also, when a mobile moves it suffers constantly varying multipath interference which produces varying audio quality. Mobile cellular networks also require expensive backhaul networks which consist of expensive switches and an expensive master control centre which handle the movement of mobiles from one cell to another.

Radio systems based on mobile standards with fixed directional antennas are sometimes used to provide access to the public telephone network. The directional antenna discriminates against some of the multipath interference. However, the system still suffers from the disadvantages already mentioned. For example, an expensive backhaul network is required and the speech quality is inferior to a copper wire system.

Fixed wireless access systems comprise a base station serving a radio cell of up to 5 km radius (for example). The base station interfaces with the subscriber system via a purpose designed air interface protocol. The base station also interfaces with the public telephone network for example, this interface can be the ITU G.703 2048 kbit/s, 32 timeslot, 30 channel standard known as E1 or the North American 24 timeslot standard known as T1.

Typically, each uplink radio channel (i.e. from a subscriber antenna to a base station) is paired with a downlink radio channel (i.e. from, a base station to a subscriber antenna) to produce a duplex radio channel. For voice signals the up and down link channels in a pair normally have the same frequency separation (e.g. 50 MHz between uplink and downlink channels) because this makes the process of channel allocation simple. However, it is possible for the up and down link channels in a pair to have different frequency separations. Often each downlink transmits continuously and it is usual for those downlink bearers used to carry broadcast information to transmit continuously. In the uplink each subscriber antenna typically only transmits a packet of information when necessary.

A bearer is a frequency channel and will often have several logical channels, for example, time divided or code divided channels. Base stations are then allocated radio bearers from the total available, for example, 54. As the subscriber population increases the base station capacity can be increased by increasing the number of bearers allocated to it, for example, 3, 6 or 18 bearers.

As already mentioned, fixed wireless access systems divide a geographic area to be covered into cells. For initial planning and design purposes these cells are usually represented as hexagons, each cell being served by a base station (in the centre of the hexagon) with which a plurality of subscriber stations within the cell (hexagon) communicate. When detailed cell planning is performed the ideal hexagonal arrangement can start to break down due to site constraints or for radio propagation reasons. The number of subscriber stations which can be supported within each cell is limited by the available number of carrier frequencies and the number of channels per frequency.

Base stations are expensive, and require extensive effort in obtaining planning permission for their erection. In some areas, suitable base station sites may not be available. It is preferred in fixed wireless access system design to have as few base stations as possible, whilst supporting as many subscriber stations as possible. This helps to reduce the cost per subscriber in a fixed wireless access system. An on-going problem is to increase the traffic carrying capacity of base stations whilst at the same time keeping interference levels within acceptable bounds. This is referred to as trying to optimise or increase the carrier to interference level or C/I ratio. By increasing the traffic capacity the number of lost or blocked calls is reduced and call quality can be improved. (A lost call is a call attempt that fails).

Cells are typically grouped in clusters as shown in FIG. 1. In this example, a cluster of seven cells is shown and for a 6 bearer system, each cell in the cluster may use a different group of 6 frequencies out of the total available (for example, 54). Within each cluster 7×6=42 frequencies are each used once. This leaves 12 channels for in-fill if required. Within the cluster all channels are orthogonal, for example, separated by emitter time and/or frequency, and therefore there will be no co-channel interference within this isolated cluster.

FIG. 2 shows how a larger geographical area can be covered by re-using frequencies. In FIG. 2 each frequency is used twice, once in each cluster. Co-channel interference could occur between cells using the same frequencies and needs to be guarded against through cell planning. When the capacity of a cell or cluster is exhausted one possibility is to sectorize each cell. This involves using directional antennas on the base station rather than omnidirectional antennas. The 360° range around the base station is divided up into a number of sectors and bearers are allocated to each sector. In this way more bearers can be added whilst keeping interference down by only using certain frequencies in certain directions or sectors. For example, up to 12 bearers per cell could be added giving a total of 18 bearers per cell, the number of cells in a cluster drops to three, as shown in FIG. 3. This is because all 54 frequencies are used in the cluster and will be re-used in other clusters.

Known approaches for seeking to increase system capacity include frequency planning which involves carefully planning re-use patterns and creating sector designs in order to reduce the likelihood of interference. However, this method is complex and difficult and there is still the possibility that unwanted multipath reflections may cause excessive interference. Frequency planning is also expensive and time consuming and slows down the rate of deployment. Some of the difficulties with frequency planning include that it relies on having a good terrain base and a good prediction tool.

WO96/13952 describes a method for hexagonal sectored obtaining a one cell re-use pattern in a wireless communications system but does not provide a suitable operational system.

OBJECT OF THE INVENTION

The present invention seeks to provide a base station arrangement in a fixed wireless access system, which overcomes or at least mitigates one or more of the problems noted above. It is sought to increase the traffic carrying capacity of base stations whilst at the same time keeping interference levels to a minimum.

SUMMARY OF THE INVENTION

According to the present invention there is provided an antenna arrangement for a fixed wireless access base station comprising at least one pair of directional antenna wherein the pair of antennas have a common phase centre. Ensuring that the antenna have a common phase centre means that any co-frequency same sector interference signals experienced by the first antenna of the pair and which is associated with the sidelobes of the second antenna of the pair will fade in a manner which is correlated with the fading of the main signal associated with the main lobe of the first antenna. Therefore, the ratio between the strength of the main signal and the strength of the interference signal is held substantially constant over the sector. This is advantageous for networks in which there is a tough front to back sidelobe ratio for the base station antenna arrangement.

Where both antenna in the pair operate on at least one common frequency channel co-channel interference is more manageable and so both antenna in the pair can operate on a majority of common frequency channels or indeed have all frequencies in common. This can facilitate same cell frequency re-use and thus can increase capacity.

The two antenna in each pair are preferably oppositely directed and a plurality of pairs of antenna are arranged spaced apart in a tier about a support so as to provide cell sector coverage. Preferably, the antenna each have a substantially horizontal bore sight.

To provide a good C/I ratio it is preferable that each of the antenna pairs operate on at least one frequency channel which is different from those on which the other antenna pairs operate.

In order to provide spatial diversity a second tier of antenna substantially the same as the first and which is vertically separated from the first tier is added. Preferably, the antenna pairs in the second tier are located to the opposite side of the support to the equivalent antenna pair of the first tier. Again this provides diversity, but also ensures that the antennas do not physically block each other.

To provide coverage in each sector from an antenna in the first tier and in the second tier, each antenna in the second tier is directed with its bore sight in the same direction as the equivalent antenna in the first tier. A further advantage provided by this arrangement is that if there is a soft fail for one antenna group, then the existence of a second independent antenna group will ensure that transceive capabilities of the base station are maintained.

In a preferred six sector arrangement three antenna pairs are arranged in each tier and are spaced 120° apart.

To increase the capacity of the antenna arrangement according to the present invention different antennas can operate with different polarisations.

If the frequency channels on which the antenna arrangement according to the present invention operate are time divided then it is preferred that the time slots for each tier of antenna are synchronised.

BRIEF DESCRIPTION OF THE DRAWINGS

In order that the present invention is more fully understood and to show how the same may be carried into effect, reference shall now be made, by way of example only, to the figures as shown in the accompanying drawing sheets, wherein.

DETAILED DESCRIPTION OF PREFERRED EMBODIMENTS

There will now be described by way of example the best mode contemplated by the inventors for carrying out the invention. In the following description, numerous specific details are set out in order to provide a complete understanding of the present invention. It will be apparent, however, to those skilled in the art that the present invention may be put into practice with variations of the specific.

Figure 5:
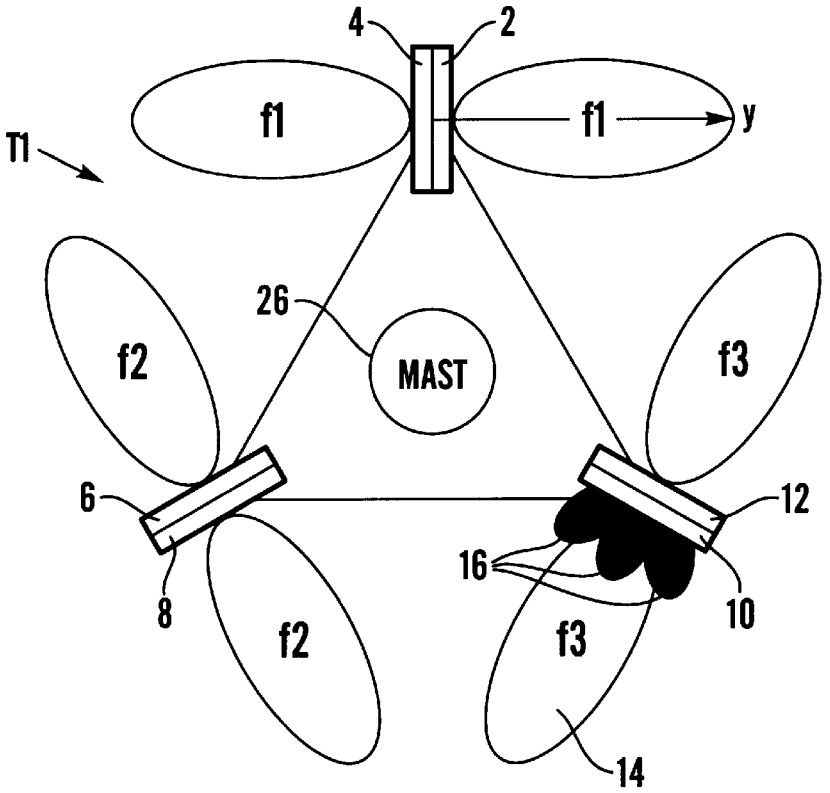
FIG. 5 shows a plan view of a first tier of the antenna arrangement of FIG. 4.

The first tier T1 of the antenna arrangement shown in FIG. 5 comprises 6 directional antennas (2, 4, 6, 8, 10 and 12). The 6 antennas are arranged in pairs. Each pair is arranged in a back-to-back configuration with a common phase centre and each pair operate in the same group of frequencies, for example frequency group f3 for antennas 10 and 12.

A phase centre is the point from which an antenna seems to be radiating.

By having a common phase centre the main front facing lobe of one of each pair of antenna (for example the main lobe 14 of antenna 10) has substantially the same phase centre as the rear facing side lobes of the other of each pair of antenna (for example the side lobes 16 of antenna 12). Accordingly, the signals of interest which are associated with the main lobe 14 of antenna 10 and the same sector co-channel interference signals which are associated with the side lobes 16 of antenna 12 follow substantially the same paths. If the signal of interest and the interference signals follow substantially the same path they will encounter substantially the same obstacles and therefore will experience the same level of attenuation. This enables a constant ratio to be maintained between the strength of the signals of interest and interference signals in each directional sector of a cell. Therefore, an interference signal experiencing a low attenuation level along its path through space is unlikely to approach the strength of the main signal because the main signal will also have experienced the same low level of attenuation.

Figure 6:
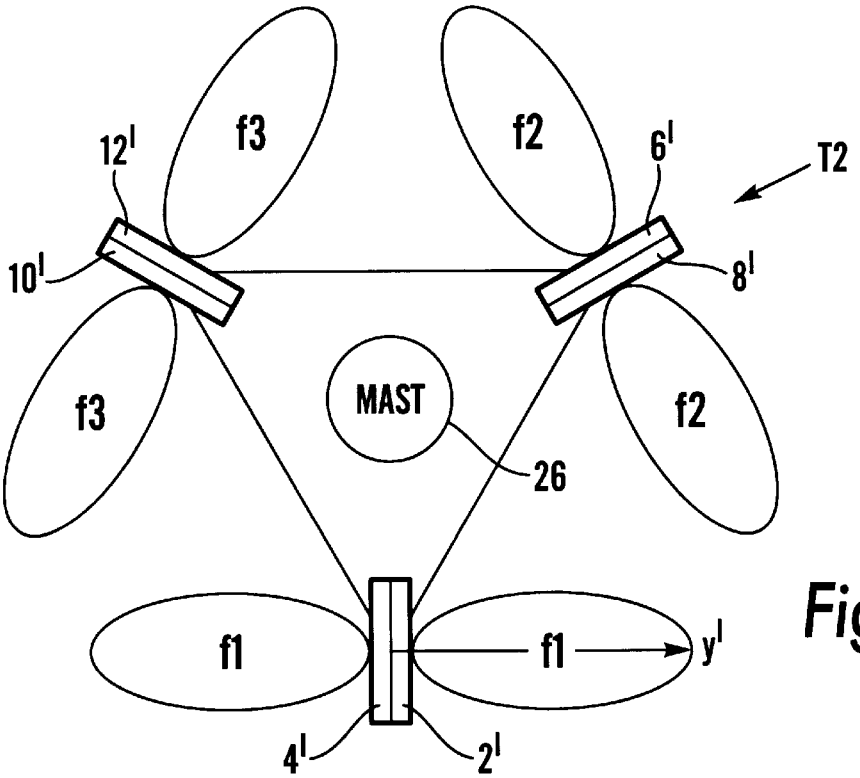
FIG. 6 shows a plan view of a second tier of the antenna arrangement of FIG. 4.

The second tier T2 of antennas of FIG. 6 are superimposed on the first tier of antennas T1 described above in relation to FIG. 5. The second tier of antennas is substantially identical to the first tier of antennas, except that each pair of antennas in the second tier has been moved to the opposite side of the mast 26 from the equivalent pair (operating in the same frequency group) in the first tier. This provides spatial diversity between antennas operating in the same sector (for example 2 and 2' etc.). Therefore, if an antenna in a subscriber's unit cannot receive a strong signal from antenna 2 because of high attenuation along the signal path, it should be able to receive a strong signal from antenna 2' because hopefully the signal path to antenna 2' will not have such high attenuation.

Figure 7:
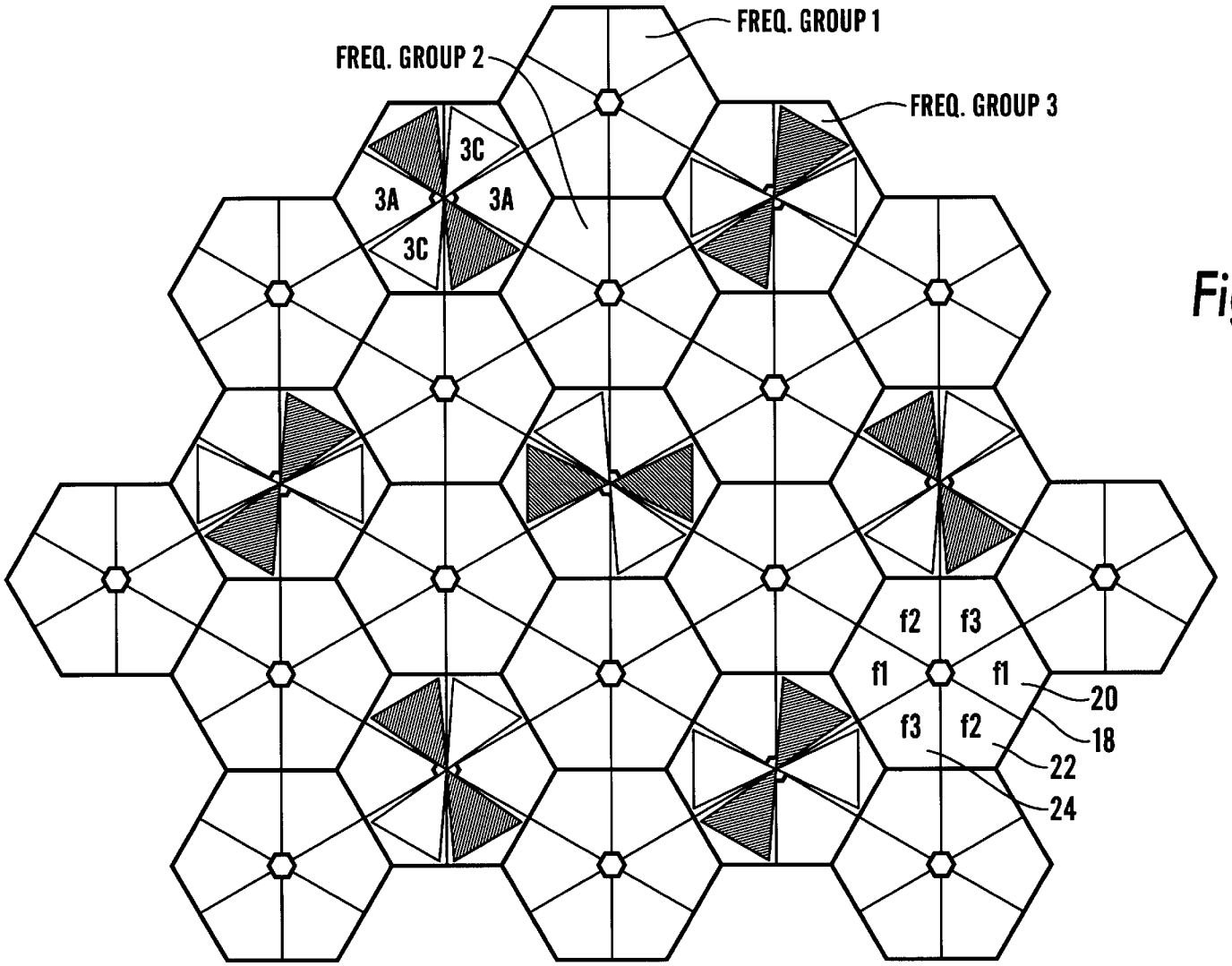
FIG. 7 shows a frequency plan which can be implemented using the antenna arrangement of FIG. 4.

Referring now to FIG. 7, which shows a cell plan associated with the antenna arrangement of FIGS. 5 and 6, with reference to cell 18, antenna 2 and 2' operate in sector 20, antenna 8 and 8' operate in sector 22, antenna 10 and 10' operate in sector 24, etc.

It can be seen from FIG. 5 that y (directed eastwardly) indicates the axis of primary receive antenna 2 coverage which is supplemented, with reference to FIG. 6, by the secondary diversity antenna 2' which provides a diversity receive antenna coverage indicated by y'. Each pair of antennas is mounted with a common phase centre for forward and reverse co-frequency transmissions whereby it is possible to maximise the correlation of fading of same-cell co-channel interference.

Figure 1:
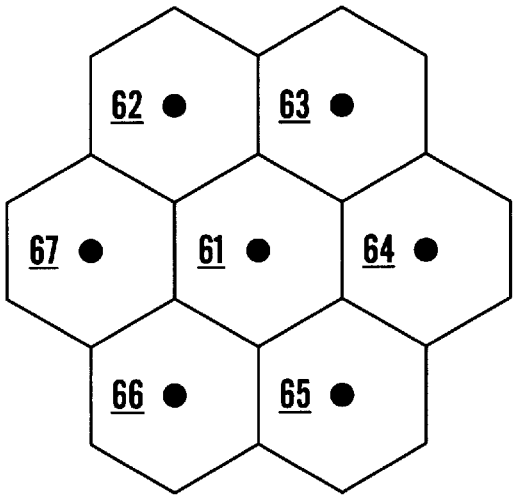
FIG. 1 shows a cluster of seven cells that are represented as hexagons.
Figure 2:
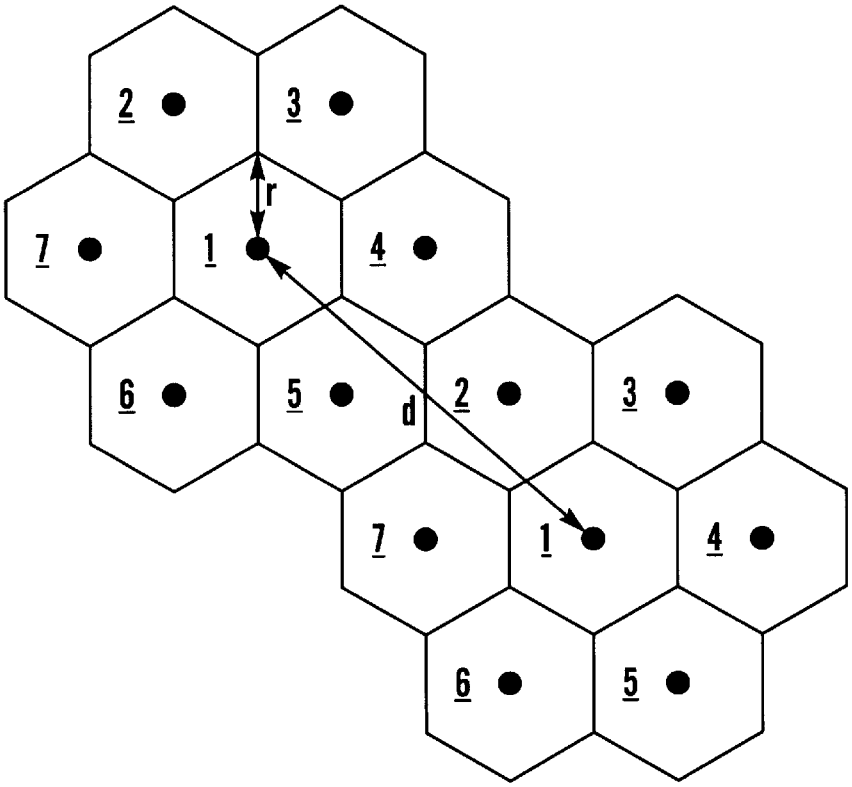
FIG. 2 shows two clusters of seven cells where each frequency is re-used twice, once in each cluster.
Figure 3A:
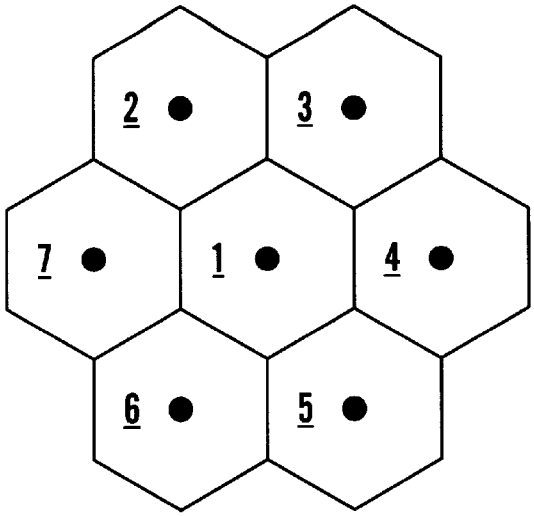
FIG. 3*a* shows a 6 bearer omni deployment with a cluster size of 7, using 42 frequencies out of the total available of 54.
Figure 3B:
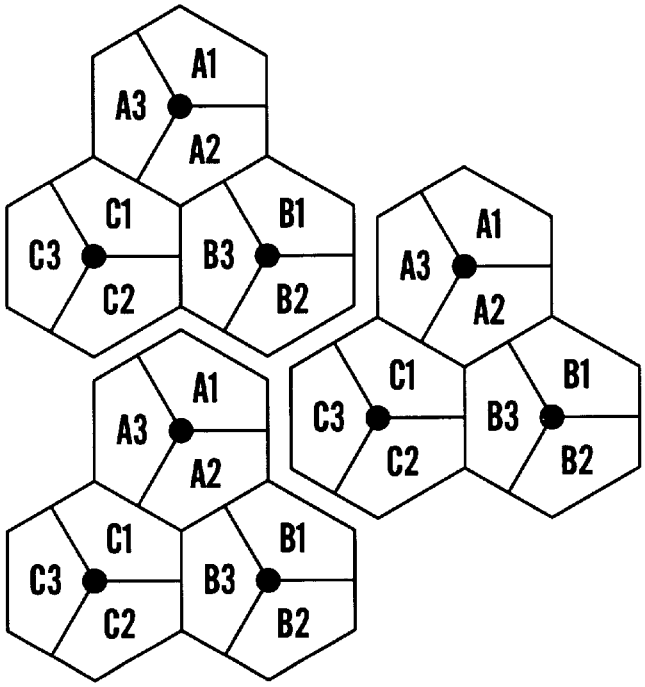
FIG. 3*b* shows the deployment of FIG. 3*a* after each cell has been sectorized by adding 12 bearers per cell giving a total of 18 bearers and tripling the capacity of each cell. The number of cells per cluster is now 3.
Figure 4:
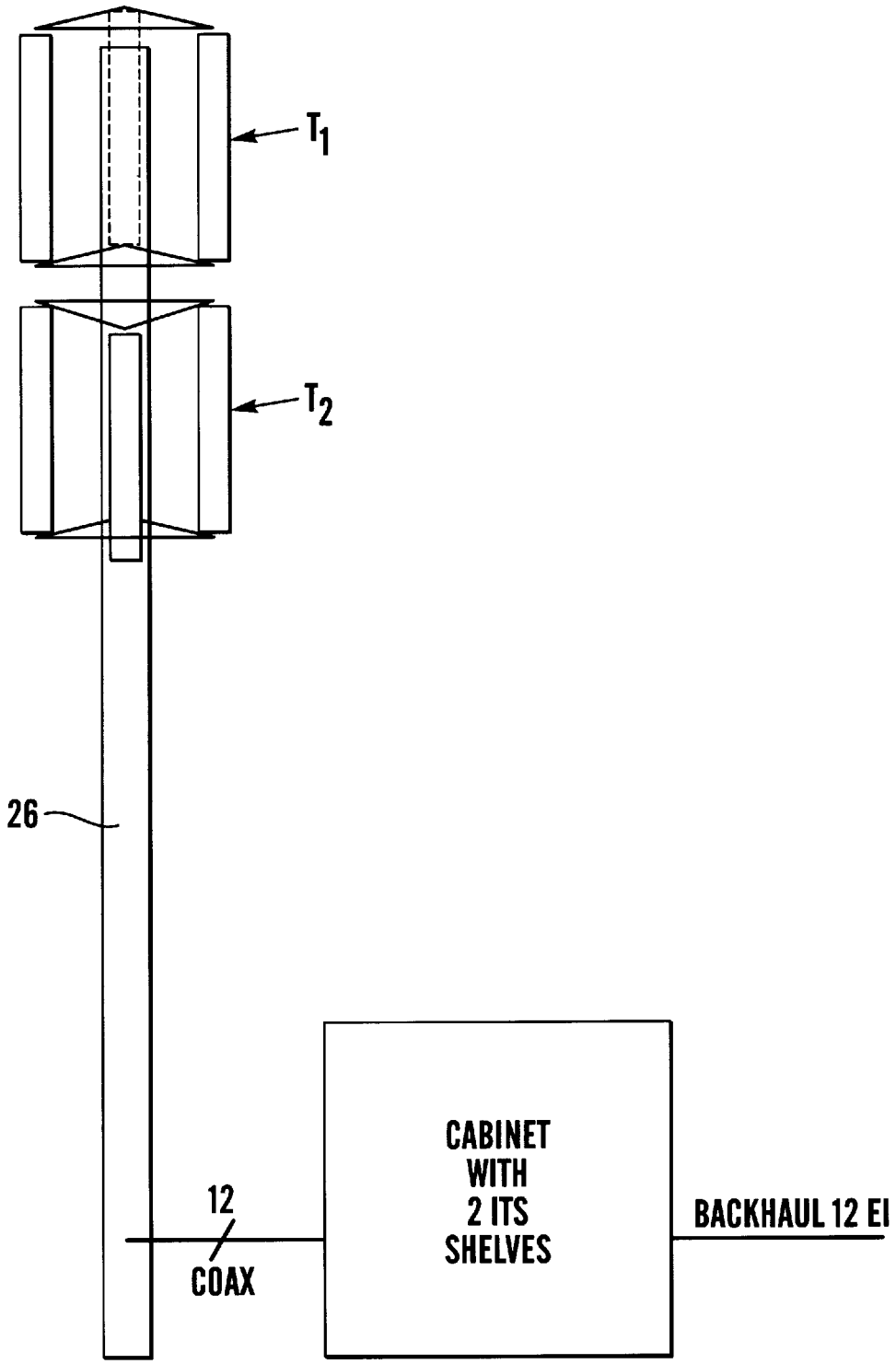
FIG. 4 shows a two tier antenna arrangement according to the present invention.

Referring now to FIG. 4 there is shown in perspective view a first embodiment of an antenna arrangement made in accordance with the invention. The antennas are arranged in groups in two vertically separated tiers, a first tier T1 as shown in FIG. 5 and a second tier T2 as shown in FIG. 6. Each antenna has a main propagation direction perpendicular to an axis from a centre of the arrangement. This centre may be coincident with a support, for example a mast 26, of course the support could comprise a geodetic-pylon like structure or other well known types.

One approach to improve the capacity of a network of base stations is to increase frequency re-use in a frequency plan. One approach, would be to use a six or nine sector frequency plan in which each frequency is used in one sector of each and every cell. A sector rotation plan increases the d/r ratio well above 3. This d/r ratio can also be achieved without sector rotation by polarisation re-use. This n=1 frequency plan requires that the subscriber unit antenna has a good sidelobe front to back ratio in order for the C/I ratio to be acceptable. This generally will require a relatively expensive subscriber unit. As there are many more subscriber units as compared to base stations, it would be more cost effective to use a frequency plan in which the base station antenna front to back ratio has to be minimised and which is less demanding on subscriber unit requirements.

FIG. 7 shows such a frequency plan which is ideally suited for use with the antenna arrangement according to the present invention. The frequency plan of FIG. 7 is a 6 sector plan suitable for 36 bearers in a paired 17 MHz spectrum or 52 bearers in a paired 25 MHz spectrum. The plan has three frequency groups (eg. frequency group 1 comprises frequency sets f1, f2 and f3) and a d/r ratio of 7 before polarisation re-use. The basic n=3 cell plan is retained i.e. each cell uses only one in 3 frequencies. Within each cell each frequency is re-used twice by base station sectoring. This frequency plan is more demanding on the base station front to back ratio (because the same frequencies are used in opposite cell sectors), but is less demanding on the subscriber station. The antenna arrangement according to the present invention providing antenna pairs having a common phase centre can be used to help meet the demands on the base station antenna requirements needed for this frequency plan.

With the frequency plan of FIG. 7 the same polarisation can be re-used throughout, with a potential to double capacity through same sector polarisation re-use, for instance on a subset of bearers.

Figure 8:
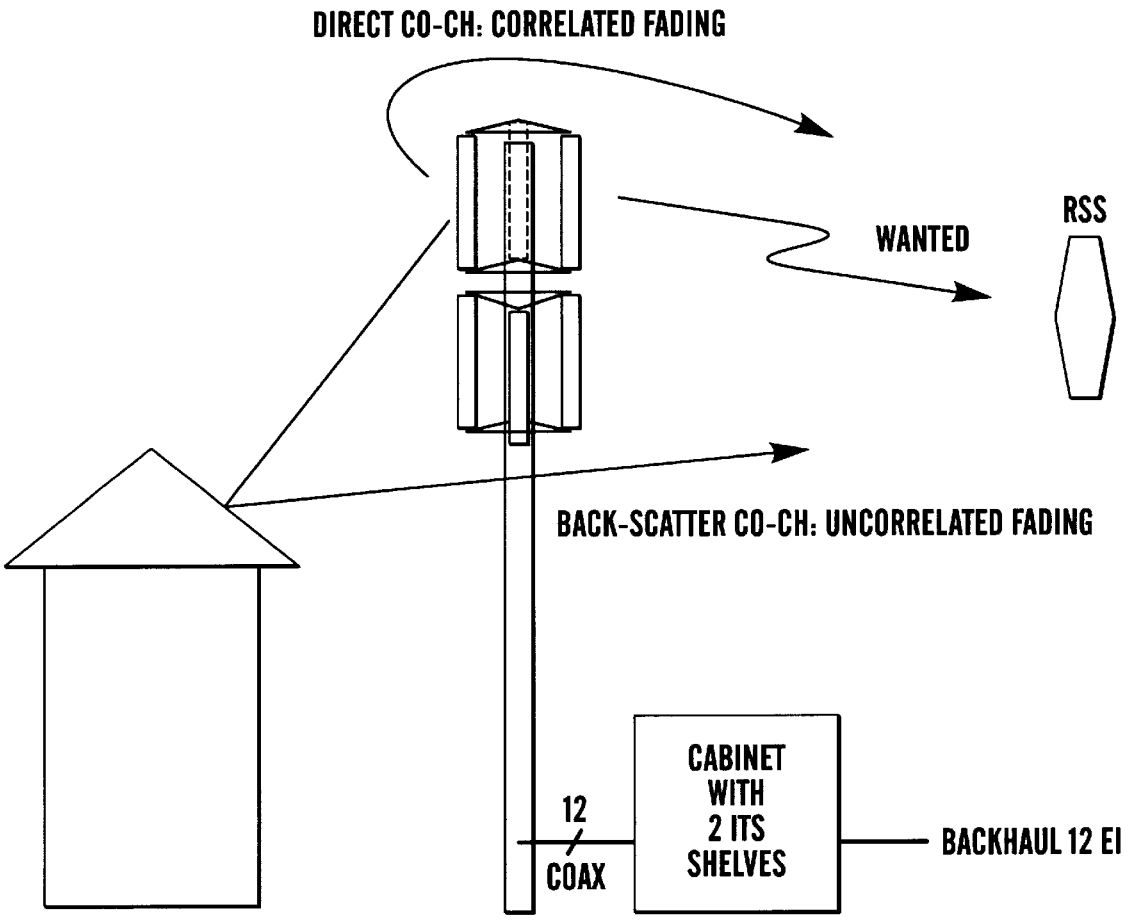
FIG. 8 shows schematically two types of downlink interference.

FIG. 8 shows two types of possible self interference. The first type is direct co-channel interference from the base station which, because of the common phase centre of the antenna pair, will experience the same attenuation as the main signal (ie. correlated fading) and so the ratio of the strength of the main signal to the interference signal remains constant. Thus, the correlation of fading of wanted signals and co-channel interference can be maximised by having common phase centres from the bi-directional and co-channel transmissions. In the limit, the C/I term becomes part of the transmission modulation accuracy specification (e.g. 26 dB C/I=5% modulation accuracy error, which is good).

The second type is back scatter interference from the environment and so its attenuation will not be correlated with respect to the main signal (ie. uncorrelated fading). Generally, polarisation is not preserved on the worst back scatter and so the transmission in the opposite direction will be at least partially oppositely polarised. Therefore this second type of interference can be significantly reduced by using different polarisations for different base station antennas.

In the proposed frequency plan a way of enhancing the C/I ratio, at least for selected bearers, is that of tiering frequency re-use. By deleting one or more bearers from each sector, a subset of bearers avoid same cell re-use and could be assigned to problem calls.

Figure 9:
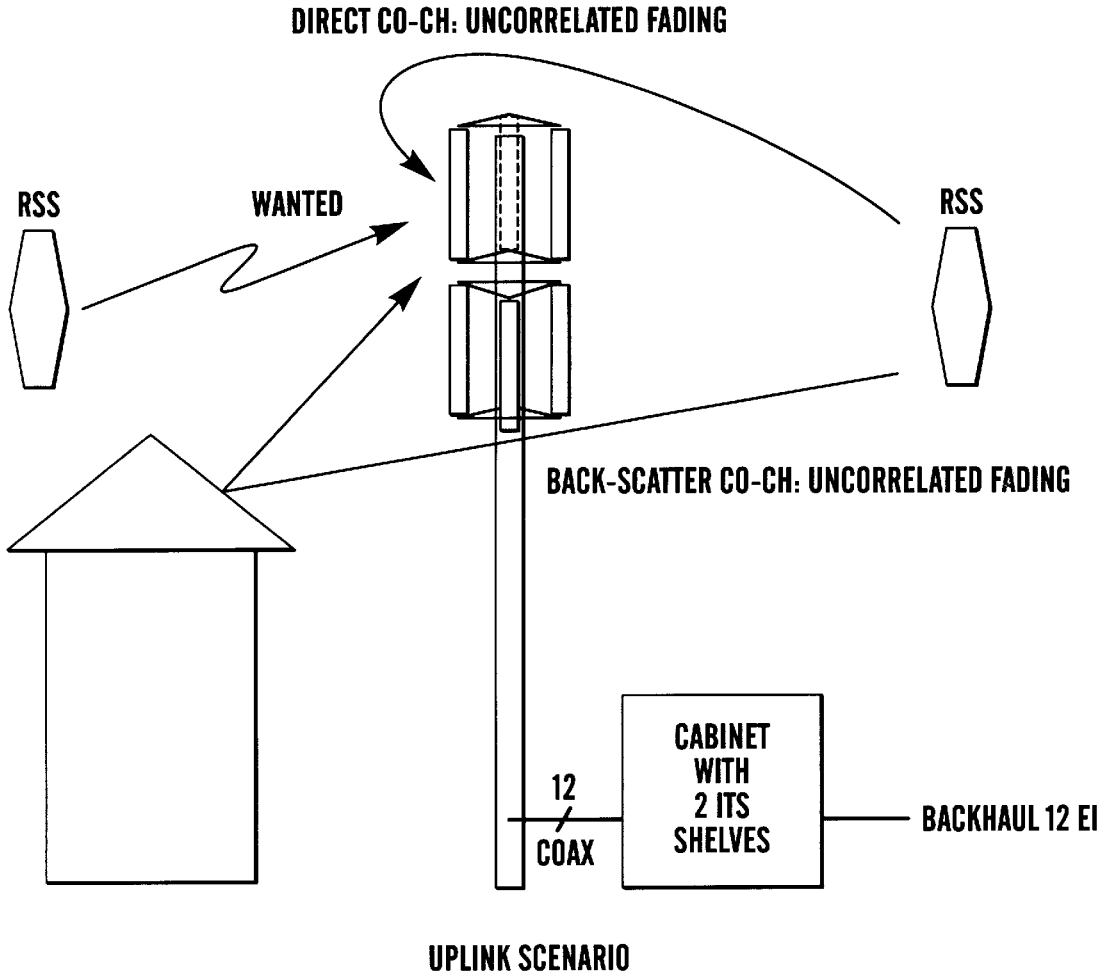
FIG. 9 shows schematically two types of uplink interference.

FIG. 9 shows a similar situation as that depicted in FIG. 8 save for the fact that the uplink is now in consideration and that other subscribers are factored in the calculations. The co-channel interference issues are determined by the near/far problem and the potential occurrence of un-correlated attenuation in two directions.

The near/far problem can be mitigated by providing automatic power control (APC) at the subscriber terminal. If at the start of a call the transmission power is too high, co-channel interference is more likely. However, if the transmission power is too low then he likelihood of excessive Frame Error Rate (FER) is increased. By the provision of diversity, using the two tier antenna arrangement according to the present invention at the base station the problems are mitigated and enables the APC set point to be as low as −90 dBm. Other action to be considered is to raise the APC set point on a desired slot (logic channel) or handoff to another slot.

Since uncorrelated fading occurs in two directions on both direct and back scattered co-channel interference, the provision of diversity improves reception considerably. The statistical gain advantage of choosing diversity over switched diversity significantly relaxes base station deployment criteria.

If time division of the bearers is used it is preferred to synchronise the time slots of the 2 co-located antenna tiers according to the present invention.

What is claimed is:

1. An antenna arrangement for a fixed wireless access base station comprising at least one pair of directional antenna wherein the pair of antennas have a common phase centre, the two antenna in each pair being oppositely directed.

2. An antenna arrangement according to claim 1 wherein both antenna in the pair operate on at least one common frequency channel.

3. An antenna arrangement according to claim 2 wherein both antenna in the pair operate on a majority of common frequency channels.

4. An antenna arrangement according to claim 1 wherein a plurality of pairs of antenna are arranged spaced apart in a tier about a support so as to provide cell sector coverage.

5. An antenna arrangement according to claim 4 wherein both antenna in each pair operate on at least one common frequency channel.

6. An antenna arrangement according to claim 5 wherein each of the antenna pairs operate on at least one frequency channel which is different from those on which the other antenna pairs operate.

7. An antenna arrangement according to claim 6 which additionally comprises a second tier of antenna substantially the same as the first and which is vertically separated from the first tier.

8. An antenna arrangement according to claim 7 wherein the antenna pairs in the second tier are located to the opposite side of the support to the equivalent antenna pair of the first tier.

9. An antenna arrangement according to claim 7 wherein each antenna in the second tier is directed with its bore sight in the same direction as the equivalent antenna in the first tier.

10. An antenna arrangement according to claim 7 wherein three antenna pairs are arranged in each tier and are spaced 120° apart.

11. An antenna arrangement according to claim 7 wherein different antennas operate with different polarisations.

12. An antenna arrangement according to claim 7 wherein the frequency channels are time divided and the time slots for each tier of antenna are synchronised.

13. An antenna arrangement according to claim 4 wherein both antenna in each pair operate on a majority of common frequency channels.

14. An antenna arrangement according to claim 4 wherein the antenna each have a substantially horizontal bore sight.

15. An antenna a arrangement according to claim 4 which additionally comprises a second tier of antenna substantially the same as the first and which is vertically separated from the first tier.

16. An antenna arrangement according to claim 15 wherein the antenna pairs in the second tier are located to the opposite side of the support to the equivalent antenna pair of the first tier.

17. An antenna arrangement according to claim 15 wherein each antenna in the second tier is directed with its bore sight in the same direction as the equivalent antenna in the first tier.

18. An antenna arrangement according to claim 15 wherein three antenna pairs are arranged in each tier and are spaced 120° apart.

19. An antenna arrangement according to claim 15 wherein different antennas operate with different polarisations.

20. An antenna arrangement according to claim 15 wherein the frequency channels are time divided and the time slots for each tier of antenna are synchronised.

* * * * *